US007687982B2

(12) United States Patent
Cho et al.

(10) Patent No.: US 7,687,982 B2
(45) Date of Patent: Mar. 30, 2010

(54) ELECTRON EMISSION DEVICE, ELECTRON EMISSION DISPLAY DEVICE INCLUDING THE ELECTRON EMISSION DEVICE, AND METHOD OF DRIVING THE ELECTRON EMISSION DEVICE

(75) Inventors: Sung-Hee Cho, Suwon-si (KR); Jong-Hwan Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 748 days.

(21) Appl. No.: 11/510,560

(22) Filed: Aug. 28, 2006

(65) Prior Publication Data

US 2007/0120776 A1 May 31, 2007

(30) Foreign Application Priority Data

Oct. 31, 2005 (KR) ..... 10-2005-0103455

(51) Int. Cl.
*H01J 1/62* (2006.01)

(52) U.S. Cl. ..... 313/497; 313/476; 313/506; 313/509

(58) Field of Classification Search ..... 313/621, 313/231.31, 491, 493, 494, 495–497, 498–507, 313/512, 309–311, 509, 306; 315/169.3, 315/169.4

See application file for complete search history.

(56) References Cited

U.S. PATENT DOCUMENTS 7,239,079 B2 * 7/2007 Choi et al. ..... 313/497
2006/0246813 A1 * 11/2006 Lee et al. ..... 445/59

* cited by examiner

*Primary Examiner*—Tuyet Vo
(74) *Attorney, Agent, or Firm*—Stein McEwen, LLP

(57) ABSTRACT

An electron emission device that is driven at a low voltage has lower power consumption, and can be mass-produced. An electron emission display device includes the electron emission device, The electron emission device includes: a base substrate; a cathode electrode disposed on the base substrate; an electron emission source disposed on the cathode electrode; a data electrode disposed above the electron emission source; a scan electrode disposed above the data electrode; and insulating layers insulating each electrode from the other electrodes. A method of driving the electron emission device includes maintaining a voltage at the cathode electrode of below 0 V or a ground level, maintaining a positive voltage at the scan electrode, and maintaining a voltage at the data electrode of below 0 V; and intermittently providing a positive voltage at the data electrode for a predetermined period of time such that electrons can travel toward the scan electrode for the predetermined period of time.

17 Claims, 3 Drawing Sheets

FIG. 4
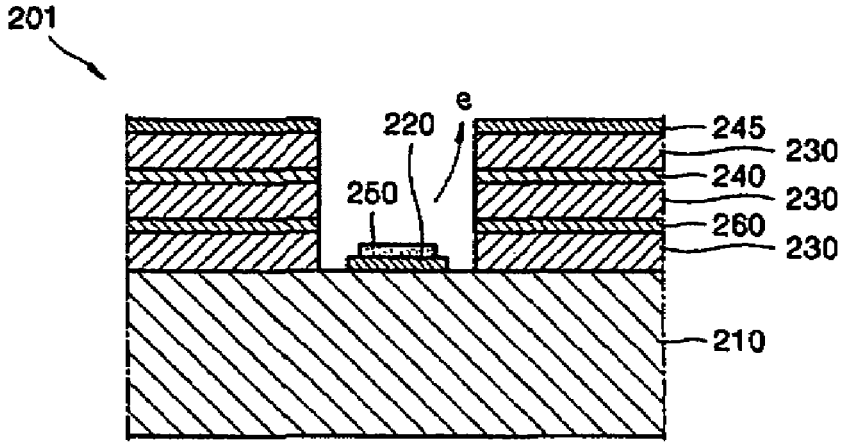
FIG. 5A
FIG. 5B
FIG. 5C
FIG. 5D
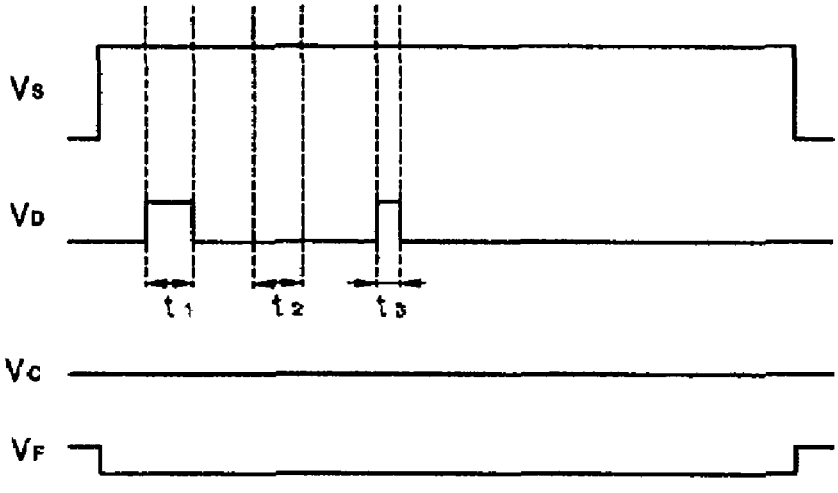

ELECTRON EMISSION DEVICE, ELECTRON EMISSION DISPLAY DEVICE INCLUDING THE ELECTRON EMISSION DEVICE, AND METHOD OF DRIVING THE ELECTRON EMISSION DEVICE

CROSS-REFERENCE TO RELATED APPLICATIONS

This application claims the benefit of Korean Patent Application No. 2005-103455, filed on Oct. 31, 2005, in the Korean Intellectual Property Office, the disclosure of which is incorporated herein by reference.

BACKGROUND OF THE INVENTION

1. Field of the Invention

Aspects of the present invention relate to an electron emission device, an electron emission display device including the electron emission device and a method of driving the electron emission device, and more particularly, to an electron emission device that is driven at a low voltage, has low power consumption, and can be mass-produced, an electron emission display device including the electron emission device, and a method of driving the electron emission device.

2. Description of the Related Art

Generally, electron emission devices use a thermal cathode or a cold cathode as an electron emission source. Electron emission devices that use a cold cathode as an electron emission source include field emission device (FED) type devices, surface conduction emitter (SCE) type devices, metal insulator metal (MIM) type devices, metal insulator semiconductor (MIS) type devices, ballistic electron surface emitting (BSE) type devices, etc.

An FED type electron emission device uses the principle that, when a material having a low work function or a high β function is used as an electron emission source, the material readily emits electrons in a vacuum due to an electric potential. Devices that employ a tapered tip structure formed of, for example, Mo, Si as a main component, a carbon group material such as graphite, diamond like carbon (DLC), etc., or a nano structure such as nanotubes, nano wires, etc., have been developed.

In an SCE type electron emission device, an electron emission source includes a conductive thin film having a nano-size gap between first and second electrodes disposed parallel to each other on a substrate. The electron emission device makes use of the principle that electrons are emitted from the micro cracks, which are electron emission sources, when a current flows on the surface of the conductive thin film due to a voltage being applied between the electrodes.

MIM type electron emission devices, which have a metal-dielectric layer-metal (MIM type) structure and MIS type electron emission devices, which have a metal-dielectric layer-semiconductor (MIS type) structure, make use of the principle that when voltages are applied to two metals having a dielectric layer therebetween or to a metal and a semiconductor having a dielectric layer therebetween, electrons migrate from the metal or the semiconductor having a high electron potential to the metal having a low electron potential.

A BSE type electron emission device includes an electron emission source that makes use of the principle that electrons travel without scattering when the size of a semiconductor is smaller than the mean-free-path of electrons in the semiconductor. To form the electron emission source, an electron supply layer formed of a metal or a semiconductor is formed on an ohmic electrode, and an insulating layer and a metal thin film are formed on the electron supply layer. When a voltage is applied between the ohmic electrode and the metal thin film, the electron emission source emits electrons.

FIG. 1 is a partial perspective view of a conventional electron emission display device 100 that uses an FED type electron emission device 101. FIG. 2 is a cross-sectional view taken along line II-II of FIG. 1. FIG. 3 is an enlarged view of a portion III of FIG. 2.

Referring to FIGS. 1 and 2, the electron emission device 101 includes a first substrate 110, a plurality of cathode electrodes 120, a plurality of gate electrodes 140, a first insulating layer 130, and a plurality of electron emission sources 150.

The first substrate 110 is a board having a predetermined thickness. The cathode electrodes 120 extend parallel to each other on the first substrate 110 and may be formed of common electrically conductive materials. The gate electrodes 140 are disposed above the cathode electrodes 120 with the first insulating layer 130 therebetween, and, like the cathode electrodes 120, may be formed of common electrically conductive materials.

The first insulating layer 130 is interposed between the gate electrodes 140 and the cathode electrodes 120 to prevent a short circuit between the gate electrodes 140 and the cathode electrodes 120.

The electron emission sources 150 are electrically connected to the cathode electrodes 120, and disposed below the gate electrodes 140. The electron emission sources 150 may be formed of a carbon material or a nanomaterial.

The electron emission device 101 can be used in the electron emission display device 100, which creates an image by generating visible light. The electron emission display device 100 further includes a front panel 102 parallel to the first substrate 110 of the electron emission device 101. The front panel 102 includes a second substrate 90, an anode electrode 80 disposed on the second substrate 90, and phosphor layers 70 disposed on the anode electrode 80.

In the electron emission display device 100, a high voltage is applied to the gate electrodes 140 such that the electron emission sources 150 emit electrons. The high voltage applied to the gate electrodes 140 increases not only the power consumption but also the manufacturing costs since integrated devices suitable for high-voltage driving are required for a driving circuit, and such devices are expensive.

SUMMARY OF THE INVENTION

Aspects of the present invention provide an electron emission device that is driven at a low voltage and has low power consumption, an electron emission display device including the electron emission device, and a method of driving the electron emission device.

Aspects of the present invention also provide an electron emission device that is driven at a low voltage, has low power consumption, and can be mass-produced, an electron emission display device including the electron emission device, and a method of driving the electron emission device.

According to an aspect of the present invention, there is provided an electron emission device including: a base substrate; a cathode electrode disposed on the base substrate; an electron emission source disposed on the cathode electrode; a data electrode disposed above the electron emission source; a first insulating layer insulating the base substrate and/or the cathode electrode from the data electrode; a scan electrode disposed above the data electrode; and a second insulating layer insulating the data electrode from the scan electrode.

According to another aspect of the present invention, there is provided an electron emission display device including: an electron emission device including: a base substrate; a cathode electrode disposed on the base substrate; an electron emission source disposed on the cathode electrode; a data electrode disposed above the electron emission source; a first insulating layer insulating the base substrate and/or the cathode electrode from the data electrode; a scan electrode disposed above the data electrode; a second insulating layer insulating the data electrode from the scan electrode; and a plurality of phosphor layers disposed in front of the electronic emission device.

According to an aspect of the present invention, the electron emission display device may further include: an anode electrode which accelerates electrons toward the phosphor layers; and a front substrate which supports the anode electrode and the phosphor layers.

According to an aspect of the present invention, the data electrode and the scan electrode may cross each other.

According to an aspect of the present invention, the electron emission device may further include a focusing electrode which is disposed above the scan electrode and focuses an electronic beam, and an insulating layer that insulates the focusing electrode from the scan electrode.

According to another aspect of the present invention, there is provided a method of driving an electron emission device including a base substrate, a cathode electrode disposed on the base substrate, an electron emission source disposed on the cathode electrode, a data electrode disposed above the electron emission source, a first insulating layer insulating the base substrate and/or the cathode electrode from the data electrode, a scan electrode disposed above the data electrode, and a second insulating layer insulating the scan electrode from the data electrode, the method including: maintaining a voltage at the cathode electrode of below 0 V or a ground level, maintaining a positive voltage at the scan electrode, and maintaining a voltage at the data electrode of below 0 V; and intermittently providing a positive voltage at the data electrode for a predetermined period of time such that electrons can travel toward the scan electrode for the predetermined period of time.

According to an aspect of the present invention, the positive voltage applied to the data electrode may be lower than the positive voltage applied to the scan electrode.

According to an aspect of the present invention, the current density of the electrons traveling toward the scan electrode may be controlled by adjusting the predetermined period of time during which the positive voltage is applied to the data electrode.

According to another aspect of the present invention, a method of driving the electron emission device comprises maintaining a voltage at the cathode electrode at a particular voltage, maintaining a voltage at the scan electrode more positive than the particular voltage, and maintaining a voltage at the data electrode at or more negative than the particular voltage; and intermittently providing a voltage at the data electrode that is more positive than the particular voltage for a predetermined period of time such that electrons can travel toward the scan electrode for the predetermined period of time.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 4 is a schematic cross-sectional view of an electron emission device according to an embodiment of the present invention; and FIGS. 5A through 5D illustrates driving waveforms $V_S$, $V_B$, $V_C$ and $V_F$ of the electron emission device of FIG. 4.

DETAILED DESCRIPTION OF THE EMBODIMENTS

Figure 1:
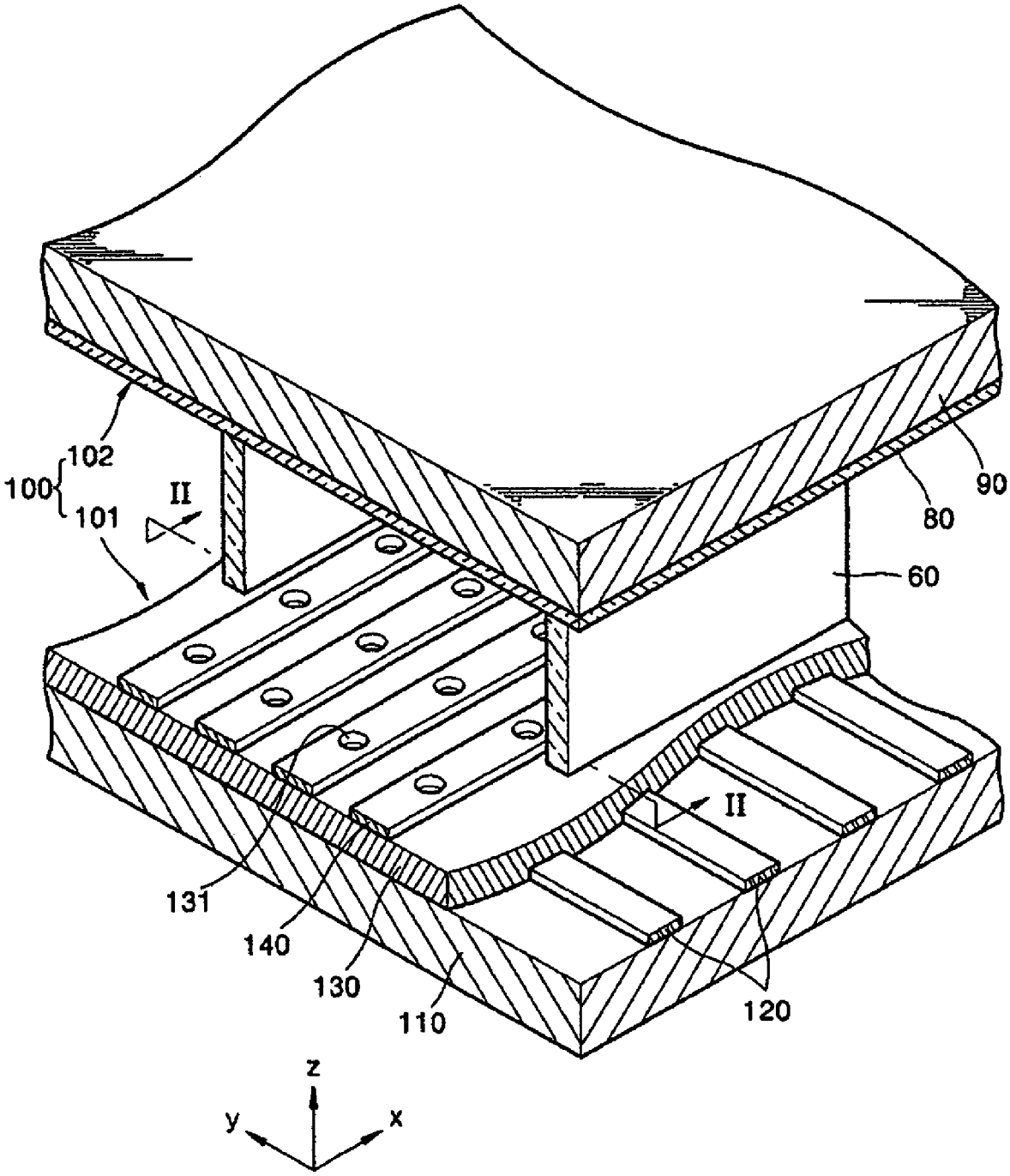
FIG. 1 (PRIOR ART)
FIG. 1 is a partial perspective view of a conventional electron emission display device that uses a field emission device (FED) type electron emission device.

Reference will now be made in detail to the present embodiments of the present invention, examples of which are illustrated in the accompanying drawings, wherein like reference numerals refer to the like elements throughout. The embodiments are described below in order to explain aspects of the present invention by referring to the figures.

FIG. 4 is a schematic cross-sectional view of an electron emission device 201 according to an embodiment of the present invention.

Referring to FIG. 4, the electron emission device 201 includes a base substrate 210, a cathode electrode 220, a scan electrode 240, insulating layers 230, 270 and 280, an electron emission source 250, a data electrode 260, and a focusing electrode 245.

The base substrate 210 is in the form of a board having a predetermined thickness, and can be, for example, a glass substrate formed of quartz glass, glass containing a small amount of an impurity such as Na, plate glass, or glass coated with $SiO_2$, aluminum oxide, or a ceramic. If a flexible display apparatus is implemented, the base substrate 210 can be formed of a flexible material.

The cathode electrode 220 extends in one direction on the base substrate 210. The cathode electrode 220 may be formed of a common electrically conductive material such as, for example, a metal such as Al, Ti, Cr, Ni, Au, Ag, Mo, W, Pt, Cu, Pd, etc. or an alloy of such metals; a printed conductive material made by mixing glass with a metal such as Pd, Ag, $RuO_2$, Pd—Ag, etc. or a metal oxide of such metals; a transparent conductive material such as ITO, $In_2O_3$, $SnO_2$, etc.; or a semiconductor material such as poly crystalline silicon, etc.

The electron emission source 250 is disposed on the cathode electrode 220. The electron emission source 250 may be formed of a carbon material or a nanomaterial. Particularly, the electron emission source 250 may be formed of a carbon material such as carbon nano tubes (CNT) having a low work function and high β function, graphite, diamond, diamond-like carbon, etc., or may be formed of a nanomaterial such as nanotubes, nano wires, nano rods, etc. Particularly, CNTs are easily driven at a low voltage since CNTs have a high electron emission characteristic. Therefore, CNTs are suitable for a large screen display device.

The first insulating layer 230 is disposed on the base substrate 210 and insulates the data electrode 260 from the base substrate 210. In places wherein the cathode electrode 220 may overlap the data electrode 260, the first insulating layer insulates the cathode electrode 220 from the data electrode 260. The second insulating layer 270 insulates the data electrode 260 from the scan electrode 240. The third insulating layer 280 insulates the scan electrode 240 from the focusing electrode 245. In addition, the insulating layers 230, 270 and 280 and the data electrode 260, scan electrode, 240 and, optionally, the focusing electrode 245 form a structure surrounding a perimeter of the electron emission source 250 and providing a path through which electrons emitted by the electron emission source 250 travel upward. In other words, as described below, the electron emission source 250 is disposed in an electron emission source hole formed in the data electrode 260, the scan electrode 240, the focusing electrode 245, and the insulating layers 230, 270 and 280.

The data electrode 260 is disposed under the insulating layer 270 and above the electron emission source 250. As used herein, terms such as "over," "above," "under," and "on" are used from the perspective of the base substrate being a back or bottom layer, and subsequent layers being on or over preceding layers. It is to be understood that the electron emission device 201 and electron emission display device can be reoriented Like the cathode electrode 220, the data electrode 260 is formed of an electrically conductive material.

The scan electrode 240 is disposed under the insulating layer 280 and above the data electrode 260. Like the cathode electrode 220 and the data electrode 260, the scan electrode 240 is formed of a common electrically conductive material.

The focusing electrode 245 is disposed on the insulating layer 280 and formed of a common electrically conductive material.

An electron emission hole in which the electron emission device 250 is disposed is formed in the data electrode 260, the scan electrode 240, the focusing electrode 245, and the insulating layers 230, 270 and 280.

FIGS. 5A through 5D illustrate driving waveforms $V_S$, $V_B$, $V_C$ and $V_F$ of the electron emission device 201 of FIG. 4.

Referring to FIGS. 5A through 5D, a voltage $V_C$ applied to the cathode electrode 220 while the electron emission device 201 is being driven is maintained at 0 V or a ground level, and a voltage $V_S$ applied to the scan electrode 240 is maintained positive.

A voltage $V_D$ applied to the data electrode 260 is maintained at 0 V. Then, for example, the voltage $V_D$ becomes positive for a period of time $t_1$, and electrons are emitted toward the scan electrode 240. For a period of time $t_2$ during which the data electrode 260 is maintained 0 V or below, electrons are not emitted toward the scan electrode 240. When the voltage $V_D$ applied to the data electrode 260 satisfies $V_C<V_D<V_S$, it is high enough for electrons to be emitted upward due to an electric field formed by the cathode electrode 220, the data electrode 260, and the scan electrode 240. In other words, the data electrode 260 blocks or facilitates the electric field between the scan electrode 240 and the cathode electrode 220.

For the number of electrons emitted during a period of time $t_3$ to be half the number of electrons emitted during the period of time $t_1$, the period of time $t_3$, during which the voltage $V_D$ is maintained positive, is half the period of time $t_1$. In other words, the number of electrons emitted toward the data electrode 260 depends on a period of time during which the voltage $V_D$ applied to the data electrode 260 is maintained at 0 V and a period of time during which the voltage $V_D$ is maintained positive. Accordingly, current density can be controlled in this way by adjusting the number of electrons emitted toward the data electrode 260. That is, for example, the voltage $V_D$ applied to the data electrode 260 can be controlled using a pulse width modulation (PWM) method to ultimately control current density.

Moreover, it is to be understood that the method described above may be practiced by controlling the relative voltages of the cathode electrode, scan electrode and data electrode, without reference to whether such voltages are positive or negative. In particular, the cathode electrode may be maintained at a particular voltage, the scan electrode may be maintained at a voltage more positive than the particular voltage, and the data electrode may be maintained at a voltage at or more negative than the particular voltage and may intermittently be provided with a voltage that is more positive than the particular voltage for a predetermined period of time. Here, too, electrons can travel toward the scan electrode during the predetermined period of time.

Figure 2:
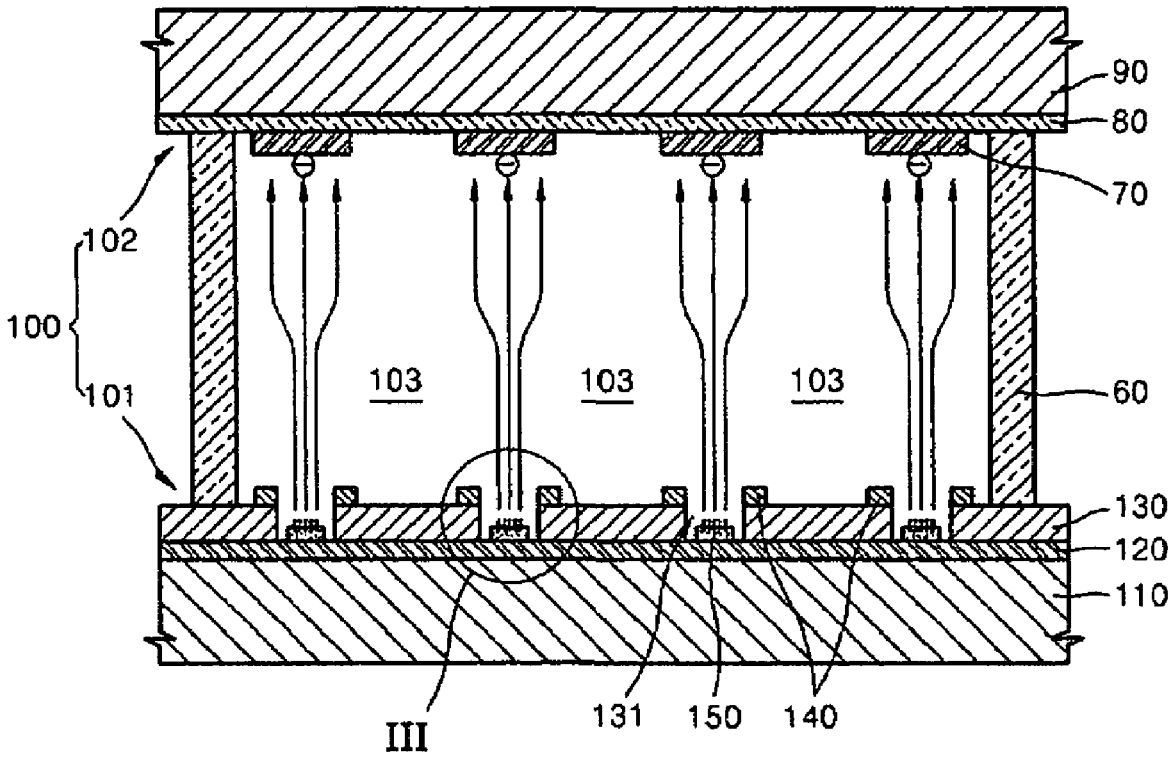
FIG. 2 (PRIOR ART)
FIG. 2 is a cross-sectional view taken along line II-II of FIG. 1.
Figure 3:
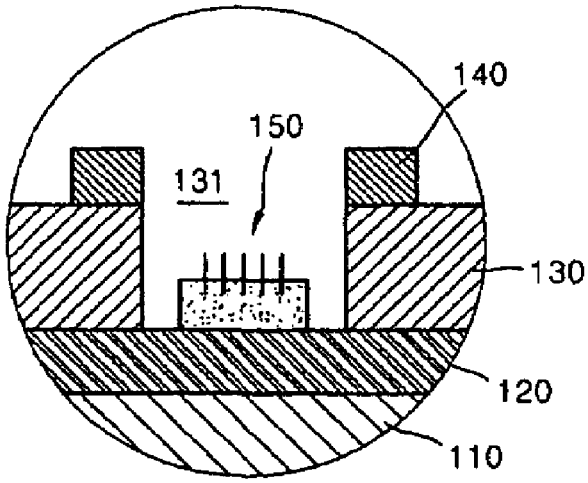
FIG. 3 (PRIOR ART)
FIG. 3 is an enlarged view of a portion III of FIG. 2.

The electron emission device 201 according to an aspect of the present invention can be used for an electron emission display device that realizes an image by generating visible light. The front panel of the electron emission display device according to an aspect of the present invention may have the same structure as the front panel 102 of the electron emission display device 100 of FIGS. 1 and 2. However, the electron emission display device differs from the electron emission display device 100 of FIGS. 1 and 2 by having the electron emission device 201 according to an aspect of the present invention instead of a conventional electron emission device 101. Accordingly, FIGS. 1 and 2 may be referred to regarding details of the front panel of the electron emission display device and identical reference numerals are used in the description of the front panel according to an aspect of the present invention. Referring to FIG. 2, the electron emission display device according to an aspect of the present invention further includes phosphor layers 70 in front of the base substrate 210 of the electron emission device 201. The phosphor layer 70 is included in a front panel 102. The front panel 102 further includes a front substrate 90 which supports the phosphor layers 70, and an anode electrode 80 which is disposed on the front substrate 90 and accelerates electrons toward the phosphor layers 70. Just as the electron emission display device 100 of FIGS. 1 and 2, may have a plurality of electron emission sources 150 disposed in electron emission source holes 131, the electron emission display device according to an aspect of the present invention may include a plurality of electron emission sources 250 disposed in electron emission source holes.

Like the base substrate 210, the front substrate 90 is a board having a predetermined thickness. The base substrate 210 and the front substrate 90 may be formed of identical materials. Like the cathode electrode 220, the data electrode 260, and the scan electrode 240, the anode electrode 80 may be formed of a common electrically conductive material, and may be a material that transmits visible light.

The phosphor layers 70 are formed of cathode luminescence (CL)-type phosphors that are excited by accelerated electrons and release visible light. Phosphors that can be used for the phosphor layers 70 include red phosphors such as "$SrTiO_3$:Pr," "$Y_2O_3$:Eu" and "$Y_2O_3S$:Eu," green phosphors such as "$Zn(Ga, Al)_2O_4$:Mn," "$Y_3(Al, Ga)_5O_{12}$:Tb," "$Y_2SiO_5$:Tb" and "ZnS:Cu, Al," and blue phosphors such as "$Y_2SiO_5$:Ce," "$ZnGa_2O_4$" and "ZnS:Ag, Cl." The phosphor layers 70 may be formed of materials other than phosphors.

To display an image instead of simply operating as a lamp for generating visible light, the scan electrode 240 and the data electrode 260 included in the electron emission device 201 may cross each other. In an electron emission display device having a plurality of electron emission sources 250, individual electron emission sources may therefore be separately addressed.

The electron emission device 201 that includes the base substrate 210 and the front panel 102 that includes the front substrate 90 are separated by a predetermined distance and face each other to form a light emission space. A plurality of spacers 60 are formed between the electron emission device 201 and the front panel 102 to maintain the gap therebetween. The spacers 60 may be formed of an insulating material.

Also, to form a vacuum space, the perimeter of the space formed by the electron emission device 201 and the front panel 102 is sealed using glass frit, and air in the space is exhausted.

The operation of the electron emission display device 100 will now be described.

To induce the emission of electrons from the electron emission source 250 toward the scan electrode 240, a voltage higher than the voltage $V_S$ applied to the scan electrode 240 is applied to the anode electrode 80 to accelerate the electrons traveling toward the anode electrode 80. The accelerated electrons generate visible light by exciting the phosphor layers 70 disposed on or near the anode electrode 80.

As illustrated in FIG. 4, the electron emission device 201 may further include the focusing electrode 245 on the scan electrode 240. The focusing electrode 245 can focus electrons emitted from the electron emission source 250 toward the phosphor layers 70 and prevent the electrons from dispersing in a horizontal direction. A negative voltage whose absolute value is smaller than that of the voltage $V_D$ applied to the data electrode 260 may be applied to the focusing electrode 245.

As described above, an electronic emission display device including an electronic emission device according to an aspect of the present invention applies a low voltage to a data electrode to control the number of electrons emitted. As a result, a driving voltage can be lowered, and power consumption can be reduced.

Accordingly, integrated devices suitable for high-voltage driving, which are expensive, are not required for a driving circuit, thereby reducing manufacturing costs and facilitating mass production.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron emission device comprising:
a base substrate;
a cathode electrode disposed on the base substrate;
an electron emission source disposed on the cathode electrode;
a data electrode disposed above the electron emission source;
a first insulating layer insulating the base substrate and/or the cathode electrode from the data electrode;
a scan electrode disposed above the data electrode; and
a second insulating layer insulating the data electrode from the scan electrode.

2. The electron emission device of claim 1, wherein the data electrode and the scan electrode cross each other.

3. The electron emission device of claim 1, further comprising:
a focusing electrode that is disposed above the scan electrode and focuses an electronic beam and
a third insulating layer that insulates the focusing electrode from the scan electrode.

4. The electron emission device of claim 1, wherein the cathode electrode the data electrode, and the scan electrode are symmetrically formed about the electron emission source.

5. An electron emission display device comprising:
an electron emission device comprising:
a base substrate;
a cathode electrode disposed on the base substrate;
an electron emission source disposed on the cathode electrode;
a data electrode disposed above the electron emission source;
a first insulating layer insulating the base substrate and/or the cathode electrode from the data electrode;
a scan electrode disposed above the data electrode;
a second insulating layer insulating the scan electrode from the data electrode; and
a plurality of phosphor layers disposed in front of the electron emission device.

6. The electron emission display device of claim 5, further comprising:
an anode electrode that accelerates electrons toward the phosphor layers; and
a front substrate that supports the anode electrode and the phosphor layers.

7. The electron emission display device of claim 5, wherein the data electrode and the scan electrode cross each other.

8. The electron emission display device of claim 5, wherein the electron emission device further comprises"
a focusing electrode that is disposed above the scan electrode and focuses an electronic beam, and
a third insulating layer that insulates the focusing electrode from the scan electrode.

9. The electron emission display device of claim 5, wherein the cathode electrode, the data electrode, and the scan electrode are symmetrically formed about the electron emission source.

10. A method of driving an electron emission device comprising a base substrate, a cathode electrode disposed on the base substrate, an electron emission source disposed on the cathode electrode, a data electrode disposed above the electron emission source, a first insulating layer insulating the base substrate and/or the cathode electrode from the data electrode, a scan electrode disposed above the data electrode, and a second insulating layer insulating the scan electrode from the data electrode, the method comprising:
maintaining a voltage at the cathode electrode of below 0 V or a ground level maintaining a positive voltage at the scan electrode, and maintaining a voltage at the data electrode of below 0 V; and
intermittently providing a positive voltage at the data electrode for a predetermined period of time such that electrons can travel toward the scan electrode for the predetermined period of time.

11. The method of claim 10, wherein the positive voltage intermittently provided at the data electrode is lower than the positive voltage at the scan electrode.

12. The method of claim 10, wherein the current density of the electrons traveling toward the scan electrode is controlled by adjusting the predetermined period of time during which the positive voltage is provided at the data electrode.

13. The method of claim 10, wherein the current density of the electrons traveling toward the scan electrode is controlled by providing the positive voltage at the data electrode according to pulse code modulation (PCM).

14. A method of driving an electron emission device comprising a base substrate, a cathode electrode disposed on the base substrate, an electron emission source disposed on the cathode electrode, a data electrode disposed above the electron emission source, a first insulating layer insulating the base substrate and/or the cathode electrode from the data electrode, a scan electrode disposed above the data electrode, and a second insulating layer insulating the scan electrode from the data electrode, the method comprising:
maintaining a voltage at the cathode electrode at a particular voltage, maintaining a voltage at the scan electrode more positive than the particular voltage, and maintaining a voltage at the data electrode at or more negative than the particular voltage; and intermittently providing a voltage at the data electrode that is more positive than the particular voltage for a predetermined period of time such that electrons can travel toward the scan electrode for the predetermined period of time.

15. The method of claim 14, wherein the voltage more positive than the particular voltage intermittently provided at the data electrode is lower than the voltage at the scan electrode.

16. The method of claim 14, wherein the current density of the electrons traveling toward the scan electrode is controlled by adjusting the predetermined period of time during which the voltage more positive than the particular voltage is provided at the data electrode.

17. The method of claim 14, wherein the current density of the electrons traveling toward the scan electrode is controlled by providing the voltage more positive than the particular voltage at the data electrode according to pulse code modulation (PCM).

* * * * *

UNITED STATES PATENT AND TRADEMARK OFFICE

CERTIFICATE OF CORRECTION

PATENT NO. : 7,687,982 B2
APPLICATION NO. : 11/510560
DATED : March 30, 2010
INVENTOR(S) : Sung-Hee Cho et al.

It is certified that error appears in the above-identified patent and that said Letters Patent is hereby corrected as shown below:

Column 7, line 62 claim 4, insert --,-- after "cathode electrode".

Signed and Sealed this

Third Day of August, 2010

David J. Kappos

David J. Kappos
*Director of the United States Patent and Trademark Office*